US008657014B2

(12) United States Patent
Rogers

(10) Patent No.: US 8,657,014 B2
(45) Date of Patent: Feb. 25, 2014

(54) ARTIFICIAL LIFT SYSTEM AND METHOD FOR WELL

(75) Inventor: Bradley Craig Rogers, Grand Prairie, TX (US)

(73) Assignee: Harbison-Fischer, Inc., Crowley, TX (US)

( * ) Notice: Subject to any disclaimer, the term of this patent is extended or adjusted under 35 U.S.C. 154(b) by 0 days.

(21) Appl. No.: 13/038,588

(22) Filed: Mar. 2, 2011

(65) Prior Publication Data

US 2011/0214880 A1 Sep. 8, 2011

Related U.S. Application Data

(60) Provisional application No. 61/310,454, filed on Mar. 4, 2010.

(51) Int. Cl.
*E21B 43/00* (2006.01)

(52) U.S. Cl.
USPC ..... 166/372; 166/374; 166/68; 418/108; 418/172

(58) Field of Classification Search
USPC ..... 166/372, 374, 68, 401, 309; 417/108, 417/172
See application file for complete search history.

(56) References Cited

U.S. PATENT DOCUMENTS

| | | | | |
|---|---|---|---|---|
| 971,612 | A | 4/1910 | Holliday | |
| 1,003,945 | A * | 9/1911 | Plicher | 417/86 |
| 1,865,873 | A | 5/1932 | Miller | |
| 1,861,843 | A * | 6/1932 | Denman | 417/86 |
| 2,021,997 | A * | 11/1935 | Hewgley | 417/108 |
| 4,025,235 | A * | 5/1977 | Newbrough | 417/54 |
| 4,711,306 | A | 12/1987 | Bobo | |
| 5,217,067 | A | 6/1993 | Landry | |
| 5,407,010 | A | 4/1995 | Herschberger | |
| 6,298,918 | B1 | 10/2001 | Franco | |
| 6,622,791 | B2 | 9/2003 | Kelley | |
| 7,445,049 | B2 | 11/2008 | Howard | |
| 7,497,667 | B2 * | 3/2009 | Parr | 417/198 |
| 2009/0145595 | A1 * | 6/2009 | Mazzanti | 166/106 |
| 2009/0194294 | A1 | 8/2009 | Williams | |

* cited by examiner

*Primary Examiner* — Yong-Suk (Philip) Ro

(74) *Attorney, Agent, or Firm* — Geoffrey A. Mantooth

(57) ABSTRACT

An artificial lift system provides a lifting mechanism located in a well. The lifting mechanism communicates with a remote intake that is located below in the well. A compressed gas source provides compressed gas to the well annulus at a pressure that is sufficient to move the well fluid from the remote intake up to the lifting mechanism. The well has an annulus and tubing. The well has isolation elements that isolate the producing formation from compressed gas in the annulus. Various sources of compressed gas can be used such as a compressor, an accumulator or a gas sales line. A controller is provided to control the intermittent application and removal of compressed gas in the annulus and also to control the operation of the lifting mechanism. The well could be a horizontal well or a vertical well. The well could be a cased hole or an open hole well.

26 Claims, 7 Drawing Sheets

ARTIFICIAL LIFT SYSTEM AND METHOD FOR WELL

This application claims the benefit of U.S. provisional patent application Ser. No. 61/310,454, filed Mar. 4, 2010.

FIELD OF THE INVENTION

The present invention relates to artificial lifting systems and methods for use in wells such as horizontal wells.

BACKGROUND OF THE INVENTION

Traditional oil and gas wells are drilled with boreholes extending from the surface vertically down to some depth to a pay zone. The pay zone contains the formation with the hydrocarbons of interest.

Some geological formations become more productive if the wells extend horizontally into and stay within the formations. Horizontal wells are initially drilled as vertical wells. At some depth, the borehole turns from vertical to horizontal. There is a radius of curvature of the borehole as it changes orientation from vertical to horizontal.

Many wells, after producing for some time, require artificial lift. For example, oil wells may require the oil to be pumped to the surface; gas wells may require liquid, such as salt water, to be pumped out so as to open the well to gas flow.

An example of one type of artificial lift mechanism is a sucker rod pump. A sucker rod pump has a barrel and a plunger located inside of the barrel. There is relative reciprocation between the plunger and the barrel, which reciprocation is provided by a string of sucker rods extending from the pump up the well to the surface.

In many horizontal wells, it is difficult to locate a sucker rod pump therein because the pump cannot traverse the curved portion of the well. The radius of curvature is too small for the length of the pump. In general, the deeper the well, the longer the pump that is needed. A long pump requires a relatively large radius in order to traverse the curve. In addition, pumps that can be installed in the horizontal section suffer from excessive wear from the sucker rod string pulling the plunger at an angle. There are also issues with the sucker rod guides wearing out allowing the sucker rod string to cut into the tubing.

SUMMARY OF THE INVENTION

An artificial lift system is for use in a well. The well extends from the surface of the earth through a producing formation. The well having an annulus. The system comprises a downhole fluid lifting mechanism located in the well. The fluid lifting mechanism has a fluid operating level wherein fluid located at the fluid operating level is operated on by the fluid lifting mechanism to be lifted to the surface. The fluid lifting mechanism communicates with a remote intake located below the fluid operating level. The annulus is in fluid communication with the remote intake. A compressed gas source is independent of the producing formation and provides compressed gas to the well annulus at a pressure sufficient to move fluids in the well from the remote intake to the fluid operating level. At least one isolation element prevents the compressed gas in the annulus from entering the producing formation.

In accordance with one aspect of the artificial lift system, a dip tube extends from the remote intake to the pump.

In accordance with another aspect, the isolation element comprises a packing seal in the annulus.

In accordance with still another aspect, the isolation element comprises a one-way valve and tubing. The tubing contains the downhole lifting mechanism and the remote intake.

In accordance with another aspect, the at least one isolation element comprises a packing seal in the annulus and a one-way valve in the tubing. The tubing contains the downhole lifting mechanism and the remote intake.

In accordance with another aspect, the compressed gas source comprises a compressor.

In accordance with another aspect, the compressed gas source comprises a gas sales line.

In accordance with another aspect, the compressed gas source comprises an accumulator.

In accordance with another aspect, a controller controls the inflow and outflow of compressed gas into the annulus.

In accordance with another aspect, the well is a horizontal well having a vertical portion and a horizontal portion. The downhole fluid lifting mechanism is located in the vertical portion of the well. The remote intake is located in the horizontal portion of the well.

In accordance with another aspect, the at least one isolation element comprises a packing seal in the annulus and a one-way valve in tubing. The tubing contains the downhole lifting mechanism and the remote intake.

In accordance with another aspect, the well is a vertical well. The downhole fluid lifting mechanism is located in the well above the producing formation. The remote intake is located in a portion of the well that is adjacent to the producing formation.

In accordance with another aspect, a standing tube extends from the isolation element toward the surface. The standing tube has an outlet. The remote intake is located below the standing tube outlet.

In accordance with another aspect, an intake tube extends from the remote intake to the pump. The intake tube is located within the standing tube.

In accordance with another aspect, an intake tube extends from the remote intake to the pump. The intake tube is located outside of the standing tube and communicates with the annulus by way of a passage through the standing tube.

There is also provided a method of lifting liquid from a well extending through a producing earth formation. The well has an annulus. A lifting mechanism is provided in a first portion of the well. A remote intake is provided in a second portion of the well, which is below the first portion. The remote intake communicates with the lifting mechanism and communicates with the annulus. The producing formation is isolated from compressed gas in the annulus. Compressed gas is provided in the annulus from a source independent of the producing formation. The compressed gas moves fluid through the remote intake to the lifting mechanism. The lifting mechanism lift is operated to lift the fluid in the well.

In accordance with another aspect, the compressed gas is intermittently provided in the annulus and released from the annulus. The lifting mechanism is intermittently operated when compressed gas is in the annulus and ceases operation of the lifting mechanism when compressed gas is released from the annulus.

In accordance with another aspect, a standing tube is provided from the isolated formation toward the earth's surface. The remote tube is located below an outlet of the standing tube.

DESCRIPTION OF THE PREFERRED EMBODIMENT

Figure 1:
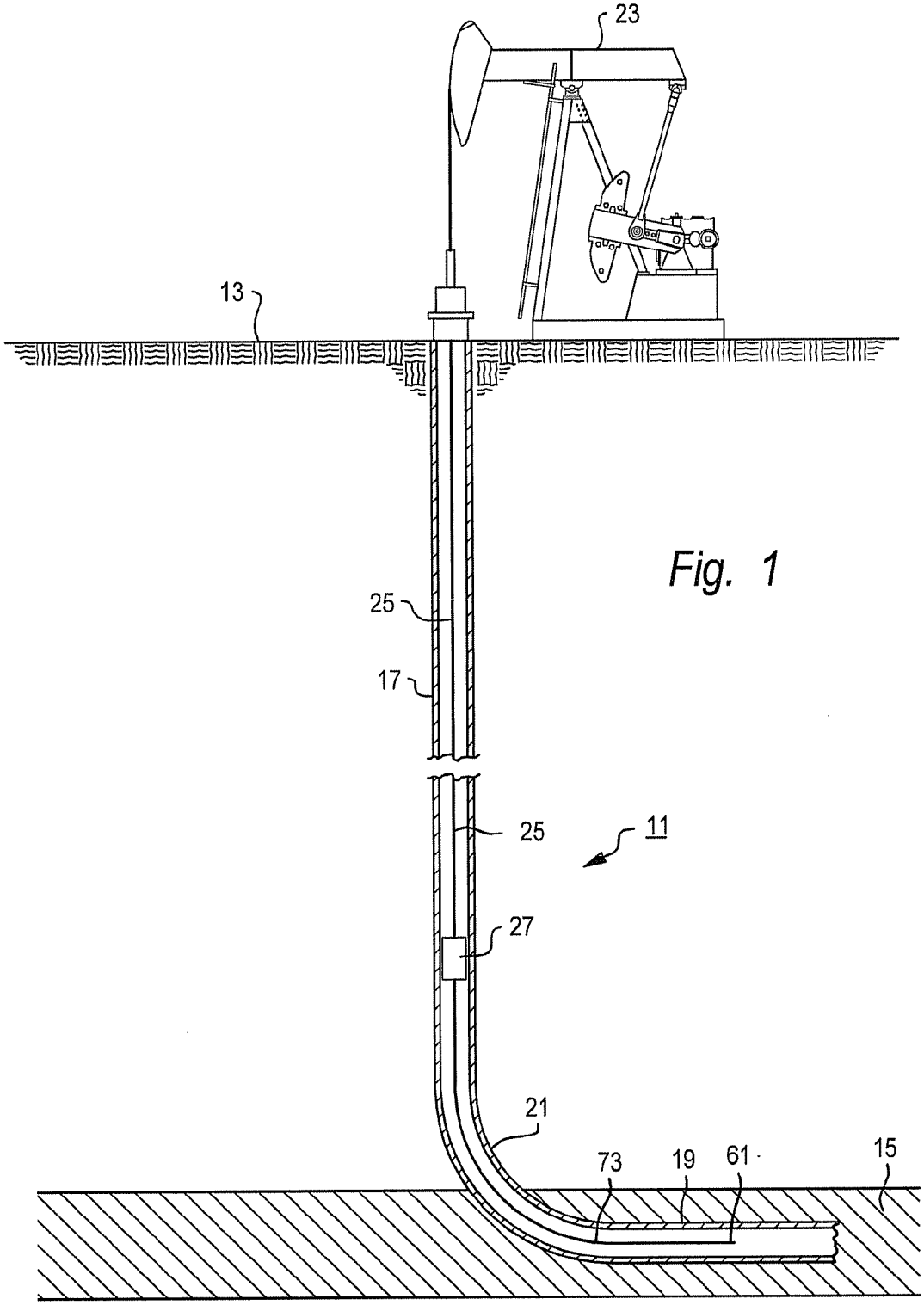
FIG. 1 is a schematic view of a horizontal well.

The system and method described herein allows the use of artificial lift in a horizontal well without the need for locating the lifting components in the horizontal portion of the well. Thus, the lifting components need not traverse the curved portion of the well. This allows a more effective artificial lift mechanism to be utilized in the well. The system and method also allow the use of artificial lift in a vertical well. There may be other features and advantages which will become known in the future.

In the description that follows, terms such as "above", "upper", and "lower" are used, with reference to the distance from the surface inside of the well. For example, in a horizontal well, a "lower" end of a component is further from the surface, through the well, than the "upper" end. Also, in the drawings, like reference numbers designate like components (for example, casing 31).

FIG. 1 shows a typical horizontal well 11 which may produce oil, water, natural gas or oil, water, and/or gas. The well extends from the surface 13 down to a hydrocarbon bearing formation 15, or pay zone. The formation 15 produces fluids in the form of liquids and/or gas. The liquids can be oil, water (such as salt water), hydrocarbons and condensate, while the gas is typically natural gas, but could be carbon dioxide, nitrogen ($N_2$), etc.

The well 11 has a vertical portion 17, a horizontal portion 19, and a curved portion 21 between the vertical and horizontal portions. The well 11 has a downhole artificial fluid lift device 27. In the description that follows, the artificial lift device is a sucker rod pump, although, as will be discussed below, other types of fluid lift devices can be used. A pumping unit 23 is located on the surface 13. Sucker rods 25 extend from the pumping unit 23 into the well to a downhole pump 27. The pumping unit reciprocates the sucker rods and operates the pump. The pumping unit 23 has a prime mover. A stuffing box (not shown) is provided at the well head for receiving a polished rod, which polished rod forms part of the sucker rod string 25.

Figure 2A:
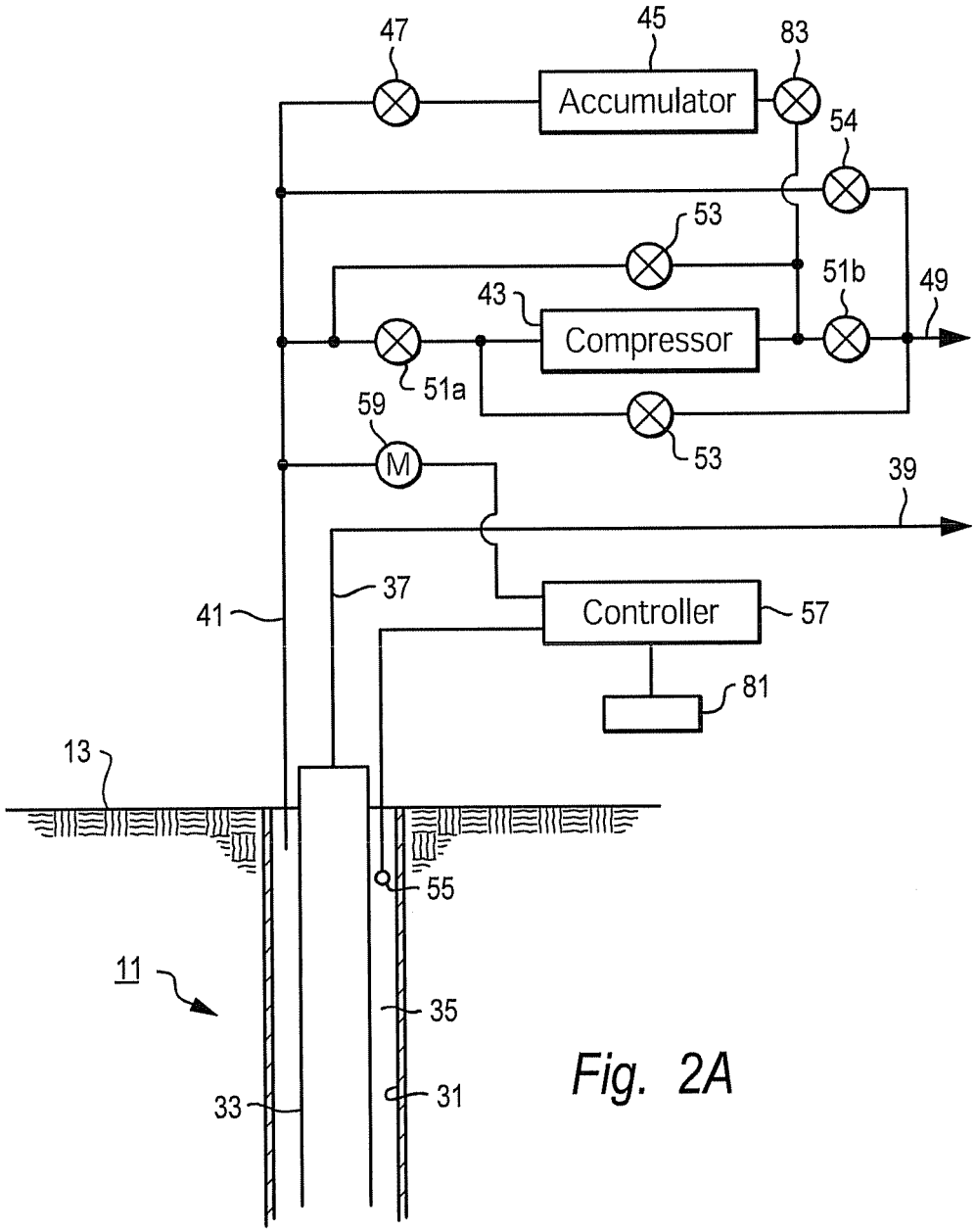
FIGS. 2A and 2B are schematic cross-sectional views of a well with the lift system of the present invention, in accordance with a preferred embodiment, with FIG. 2A showing surface equipment and FIG. 2B showing downhole equipment.
Figure 2B:
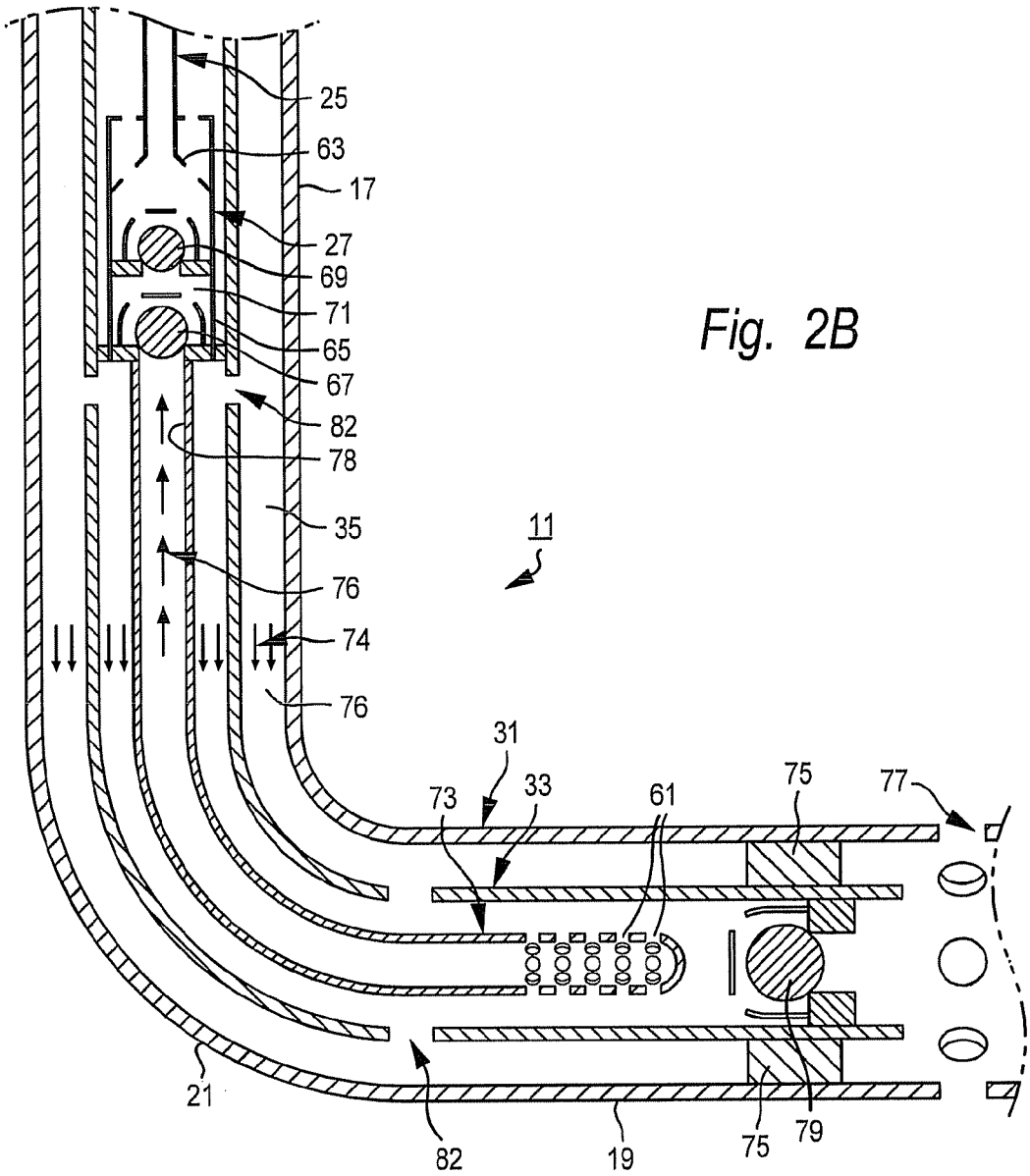

The well 11 has casing 31 (see FIGS. 2A and 2B). Located inside of the casing is a smaller diameter pipe known as tubing 33. An annulus 35 is located between the tubing and the casing.

FIG. 2A shows other surface equipment. A tubing line 37 provides fluids produced by the tubing to a sales line 39, a gas-liquid separator, a storage tank, etc. The tubing line 37 produces primarily liquid such as oil or salt water, but gas may be present. A casing line 41 extends from the annulus 35. A compressor 43 is connected to the casing line as is an accumulator 45. The accumulator 45 is connected to the casing line through a valve 47. The casing line is also connected to a gas sales line 49. The compressor 43 is provided with valves that control the flow of gas. A sales set 51 (namely, 51*a*, 51*b*) of valves provides gas from the well 11, through the compressor 43 and into the gas sales line 49. A management set 53 of valves provides gas from the gas sales line 49 through the compressor 43 and enter the annulus 35. Generally, when one set 51, 53 of valves is open, the other set of valves is closed, except when charging the accumulator, as will be discussed in more detail below.

A pressure sensor 55 is provided in the annulus 35 to measure surface pressure. The pressure sensor 55 is connected to an input of a controller 57. A flow meter 59 in the casing line may also be provided as an input for the controller 57. The controller 57 has outputs that control the operation of the compressor 43, pumping unit 23, and various valves, as will be described below.

FIG. 2B illustrates the downhole components of the well 11. The pump 27 is located in the vertical portion 17 of the well. The pump 27 has a remote intake 61 located in a horizontal portion 19 of the well.

The pump 27 is a downhole pump having a plunger 63 and a barrel 65. The barrel has a standing valve 67 and the plunger has a traveling valve 69. Between the two valves 67, 69 is a compression chamber 71. The plunger 63 is reciprocated inside of the barrel 65 by the sucker rod string 25. The pump 27 can be an insert type pump (shown in FIG. 2B) or a tubing type pump. If the pump is an insert type pump, it can be a top hold down pump or a bottom hold down pump. The pump can be of a type where the plunger is fixed and the barrel reciprocates. In other words, the pump need not be limited to the pump shown and can be of various types and styles.

The remote intake 61 comprises perforations on a dip tube 73. The dip tube 73 extends from the bottom of the pump 27 down the tubing, through the curved portion 21 of the well into the horizontal portion 19. The lower end of the dip tube has the perforations. The horizontal portion 19 of the well will in actual practice rarely be a straight line and will have dips, or low points, and peaks, or high points. Preferably, the perforated end of the dip tube, or remote intake 61, is located in a dip or low point of the horizontal portion of the well so as to capture more fluid.

Because the vertical rise of the dip tube 73 is relatively long, the pump, by itself, may have difficultly in drawing fluids up the dip tube into the compression chamber 71. Therefore, assistance is provided in the form of pressurized gas 74 in the annulus 35. The pressurized gas 74 pushes fluid 76 through the dip tube up to the pump intake. For a sucker rod pump, the pump intake is typically the standing valve 67. Ideally, the liquid at the standing valve is under sufficient pressure so that the pump draws in as much liquid as possible during the upstroke. Thus, as illustrated in FIG. 2B, the level of fluid in the dip tube can be higher than the level of liquid in the tubing (and annulus) due to the presence of compressed gas.

The pressurized gas is provided by one or more sources. As a matter of practicality, the source of compressed gas is independent of the formation 15 at the well 11. The compressor 43 (see FIG. 2A) is one source. The compressor 43 compresses the gas and provides it to the annulus 35. The gas is natural gas or some other gas. Preferably, the gas is not atmospheric air because air contains oxygen that causes corrosion to the well components. Another source of pressurized gas is the accumulator 45. The accumulator can be used to provide a volume of compressed gas in a relatively quick manner. Still another source of pressurized gas is the gas sales line 49. The gas sales line may store a sufficiently large volume of gas, particularly if the sales meter is some distance away from the well head. The sales meter, or sales point, typically marks the point at which the customer owns the gas. Gas in the sales line between the well head and the sales meter can be recaptured for use in the well without disrupting the sale of gas, or use a "buy back" meter to measure flow from the sales line.

Referring to FIG. 2B, in order to prevent the compressed annulus gas and well fluids from reentering the formation, isolating elements are used. In the preferred embodiment, the isolating elements are a packer 75 and a one-way valve 79. The packer is located in the annulus at a position that is above the casing perforations 77. The casing perforations allow fluids from the formation 15 to enter the casing 31 and thus the well. Preferably, the packer 75 is located as close as possible to the casing perforations 77. The packer can be, for example, an inflatable type, which is inflated by fluids, a mechanically actuated type, or a cup type. The one-way valve 79 is installed in the tubing to allow fluids to flow from the formation 15 toward the surface. However, the one-way valve 79 prevents fluids, whether liquid (such as well fluids) or compressed gas, from flowing back into the formation. The tubing 33 also has perforations 82 or openings at the dip tube to allow the compressed gas in the annulus to act on the fluid in the dip tube. The packer 75 and the one-way valve 79 prevent the compressed gas in the annulus from reentering the formation.

To install the pump, the packer 75 is run into the well with the tubing. The valve 79 can also be run in with the tubing, or in the alternative, the valve 79 can be installed after the tubing has been set in place. When the packer 75 is in the desired location, it is expanded to form a seal. The pump 27, with the dip tube 73, is lowered into the tubing. The dip tube is able to follow the contour of the tubing and traverse the curved portion and then the horizontal portion. The pump is now ready for operation.

The operation will now be described. Fluids from the formation 15 pass through the one way-valve 79 into the tubing 33 that contains the remote intake 61. Compressed gas is provided to the annulus 35 by the compressor 43 (or other sources such as the accumulator 45 or sales line 49). The compressed gas reverses the flow of well fluids causing the one way-valve 75 to close. The compressed gas has a pressure that is sufficient to drive the fluids up the dip tube 73 to the pump intake. The pump 27 then operates. On the upstroke of the pump plunger 63, the standing valve 67 is opened and fluid from the dip tube 73 enters the compression chamber 71. The plunger upstroke is also the lifting stroke because fluid above the closed traveling valve 69 is lifted toward the surface. On the plunger downstroke, the standing valve 67 closes and the traveling valve 69 opens, allowing fluid in the compression chamber 71 to pass through the traveling valve 69. This fluid is lifted on subsequent upstrokes toward the surface.

In order to allow well formation fluid to pass through the one-way valve 79, the pressure of the gas in the annulus is reduced for a period of time. When sufficient fluid has entered the well above the valve 79, the pressure of the gas in the annulus is increased again to drive the liquid up to the pump intake.

Figure 3:
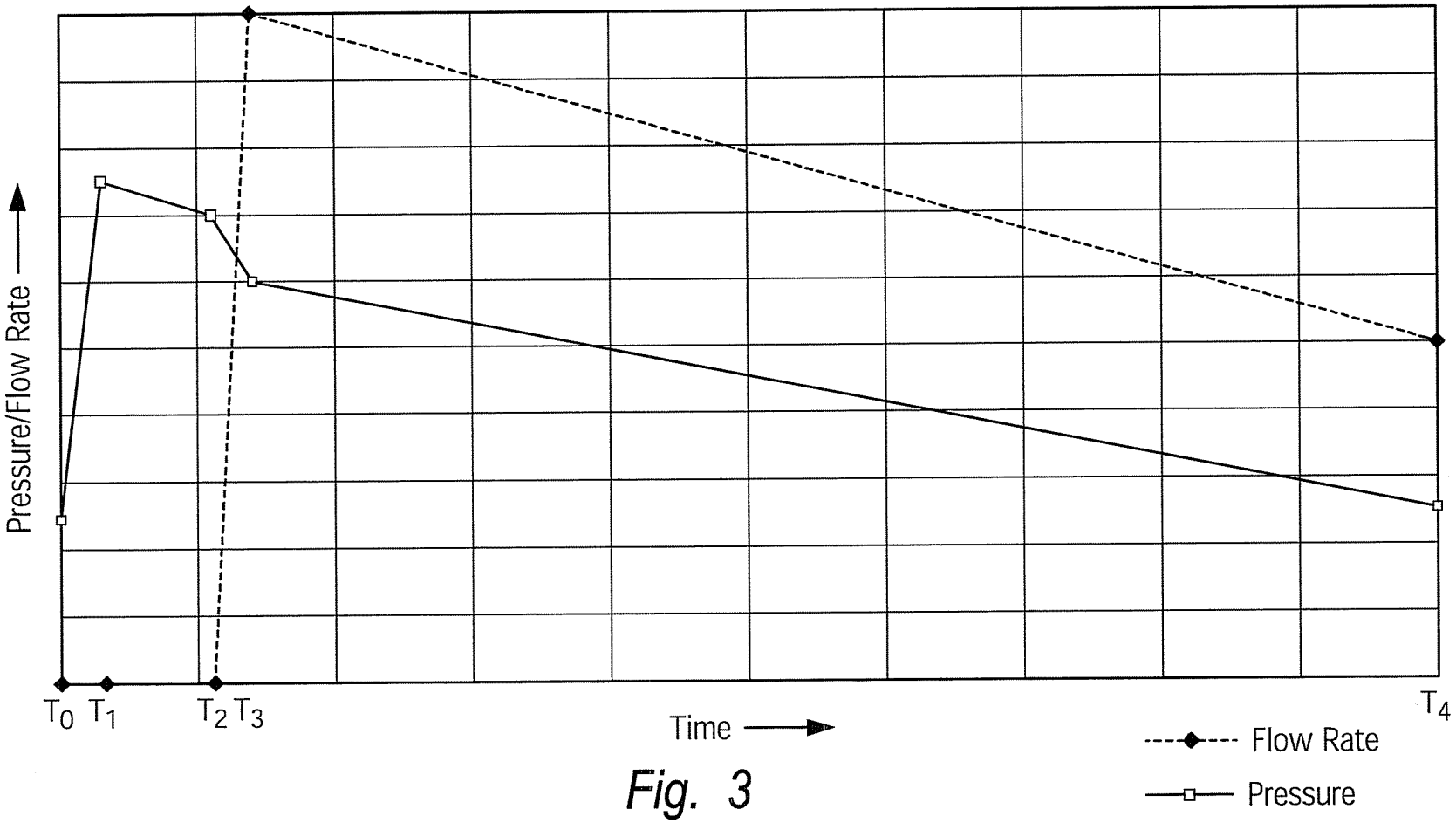
FIG. 3 is an exemplary graph of surface well pressure (shown in solid lines) and surface gas flow rate (shown in dashed lines), illustrating the operation of the lift system.

FIG. 3 shows an example of a gas well. A pump is required because the well also produces liquid such as salt water. If the liquid is allowed to build up in the well, then production of gas from the formation diminishes due to the relatively high hydrostatic pressure of the liquid, retarding gas production. Thus, the well produces gas for a time, then as production decreases, the pump is operated to pump out the liquid and gas production resumes. Pump operation is intermittent.

The chart of FIG. 3 shows pressure (in solid lines) in the well at the surface, measured by the pressure sensor 55 and flow rate (shown in dashed lines) of gas through line 41. Before time $T_0$, the well produces gas. At time $T_0$, the flow of gas from the formation has been choked or reduced by liquid in the well and the liquid needs to be pumped to the surface. At this time, the pump is off and not operating. The controller 57 senses the diminished flow of gas from the meter 59. When the flow of gas falls below a predetermined threshold, the controller prepares the well to operate the pump. Compressed gas is provided to the annulus 35. For example, the controller causes the valve set 53 (FIG. 2A) to open so that the output of the compressor 43 is provided to the casing line 41; valve set 51 is closed. The compressor 43 thus provides compressed gas to the annulus. The gas sales line 49 can be used as a source of compressed gas. The gas sales line can provide compressed gas directly to the annulus, through valve 54, or by way of the compressor through valve set 53. Still another source is the accumulator 45 accessed by opening valve 47.

Once a source of compressed gas is connected to the casing line 41, the pressure in the annulus rises from time $T_0$ to time $T_1$ (see FIG. 3). The rate of increase depends on the source. For example, the accumulator 45 typically provides a faster rate of increase (shorter time—$T_0$-$T_1$) than does the compressor. A large volume sales line 49 also may provide a faster rate of increase of pressure. The gas flow rate is still zero or minimal at time $T_1$.

At time $T_1$, the annulus 35 has reached the desired pressure, wherein the fluid is pushed up the dip tube 73 to the pump intake. The controller 57 senses the pressure and disconnects the compressed gas source from the casing line 41 by closing the appropriate valve(s). In addition, the compressor 43 may be turned off. The controller 57 then causes the pump 27 to operate by starting the pumping unit 23 (FIG. 1) (or other surface device capable of operating the pump), wherein the plunger 63 is reciprocated. The liquid 76 in the tubing is removed by the pump during times $T_1$-$T_2$. The pump continues to operate until it reaches a pump off condition, which is typically when the remote intake 61 has perforations or apertures that are uncovered by liquid and the pump starts to take in gas. The pump off condition is sensed using conventional technology such as a strain gauge 81 (See FIG. 2A) on the sucker rod string. The strain gauge provides an input to the controller 57 or a separate controller.

At time $T_2$, the pump is turned off and the well is able to produce gas again. The controller 57 operates the appropriate valve to produce gas. If an accumulator 45 or other storage vessel is used, this is recharged with gas. To charge the accumulator 45 from the annulus 35, valves 51*a* and 83 are opened, with the other valves closed. The output of the compressor is connected to the accumulator. Alternatively, the accumulator 45 can be charged from the gas sales line 49, either directly through valves 51*b* and 83 or through the compressor 43 by way of valves 53 (lower valve 53 shown in FIG. 2*a*) and 83.

Once the accumulator is charged, the remaining gas then flows into the gas sales line 49. With many gas wells, the compressor 43 is needed to bring the gas up to pressure for the gas sales line 49. This is accomplished by opening valve set 51*a*, 51*b* and closing valve set 53 so as to flow gas from the annulus through the compressor and into the gas sales line. The initial gas exiting the well is already pressurized, but this pressure drops off from times $T_2$-$T_3$. The well continues producing from times $T_3$-$T_4$. After time $T_4$, the well has once again filled with fluid, closing or reducing gas flow and the cycle repeats.

Figure 4:
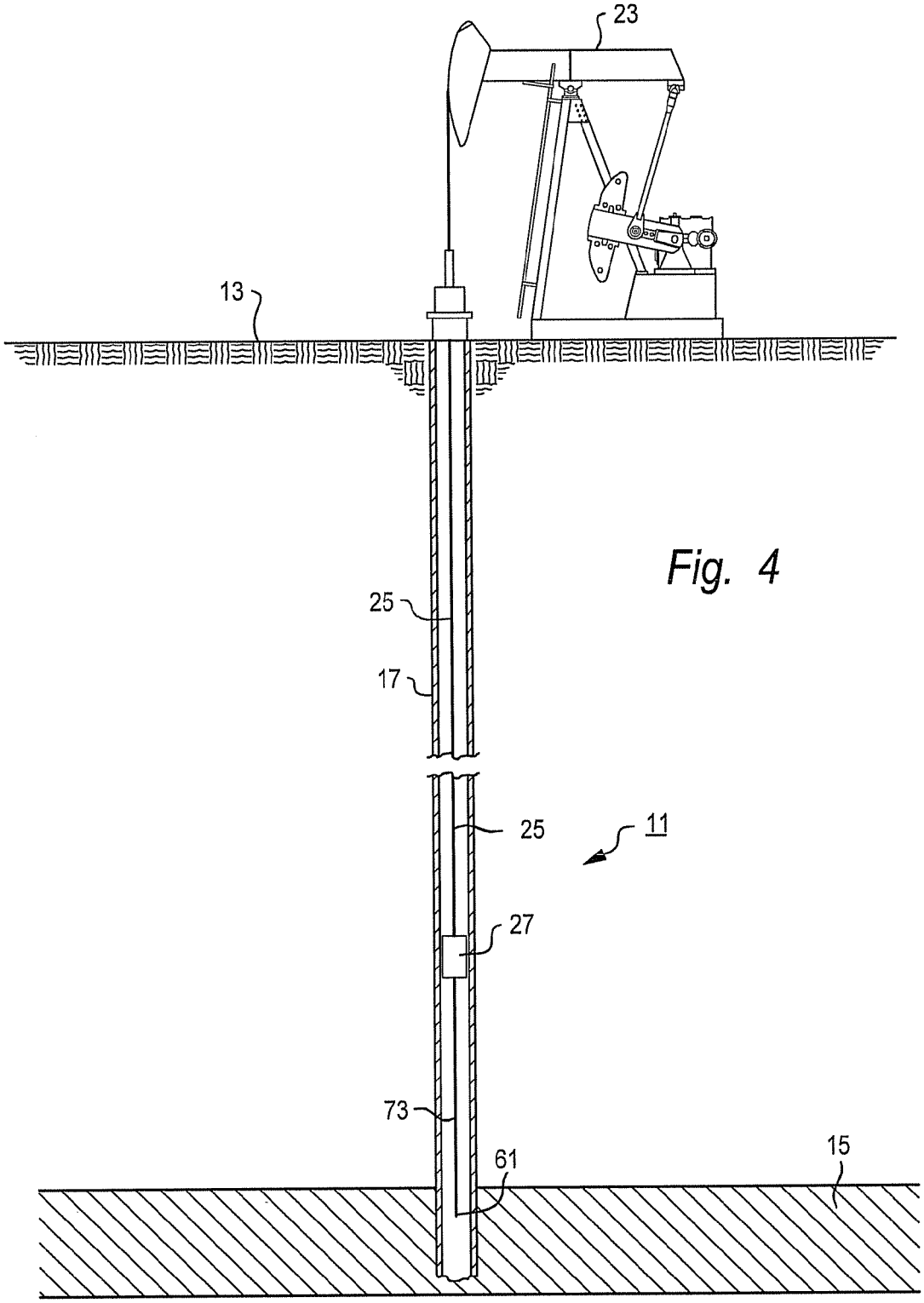
FIG. 4 is a schematic view of a vertical well with the lift system.

Although the lift system has been described in conjunction with a horizontal well, the lift system can also be used in a vertical well. Referring to FIG. 4, a typical vertical well lift is shown. The well has an artificial lift device 27 (such as a sucker rod pump). The well has casing and tubing and an annulus therebetween. The lift device 27 is located above the pay zone 15. A dip tube 73 extends down from the pump intake to a lower location. The dip tube 73 has a remote intake 61. An isolator 75,79 (shown in FIG. 2B) is used. The operation is as in a horizontal well; compressed gas is applied to the annulus to drive well liquids into the remote intake and up the dip tube to the lift device intake. The isolator prevents the compressed gas from forcing well fluids back down into the formation 15.

Another variation involves using the lift system with various types of completions. In FIGS. 2A and 2B, the well is a cased type of completion, where casing 31 extends into the horizontal portion of the well. Another type of completion is an open hole completion. Open hole completions are common in horizontal wells because of the difficultly of running casing into the horizontal portion of the well. In an open hole completed well, the casing 31 ends at the bottom of the vertical portion 17 or the entry of the curved portion 21 and does not extend into the horizontal portion 19. The packer 75 is located at or near the end of the casing and is located inside of the casing to seal the producing formation from the annulus. Alternatively, the packer could be of an open hole type suitable for sealing against the uncased borehole well. If an open hole packer is used then it need not be located in the casing. However, the packer should be above or uphole of the producing formation so that when the well is pressurized by surface gas, the producing formation will be isolated. Any perforations 82 in the tubing 33 are above the packer 75. The dip tube 73 and valve 79 remain as shown in FIG. 2A. Thus, as the compressed gas is provided to the annulus, the compressed gas is prevented from flowing into the producing formation, the packer 75 and the valve 79.

The operation of the lift system in an open hole completed well is as described with respect to a cased hole completion. The lift system can be used with other types of completions as well.

Figure 5:
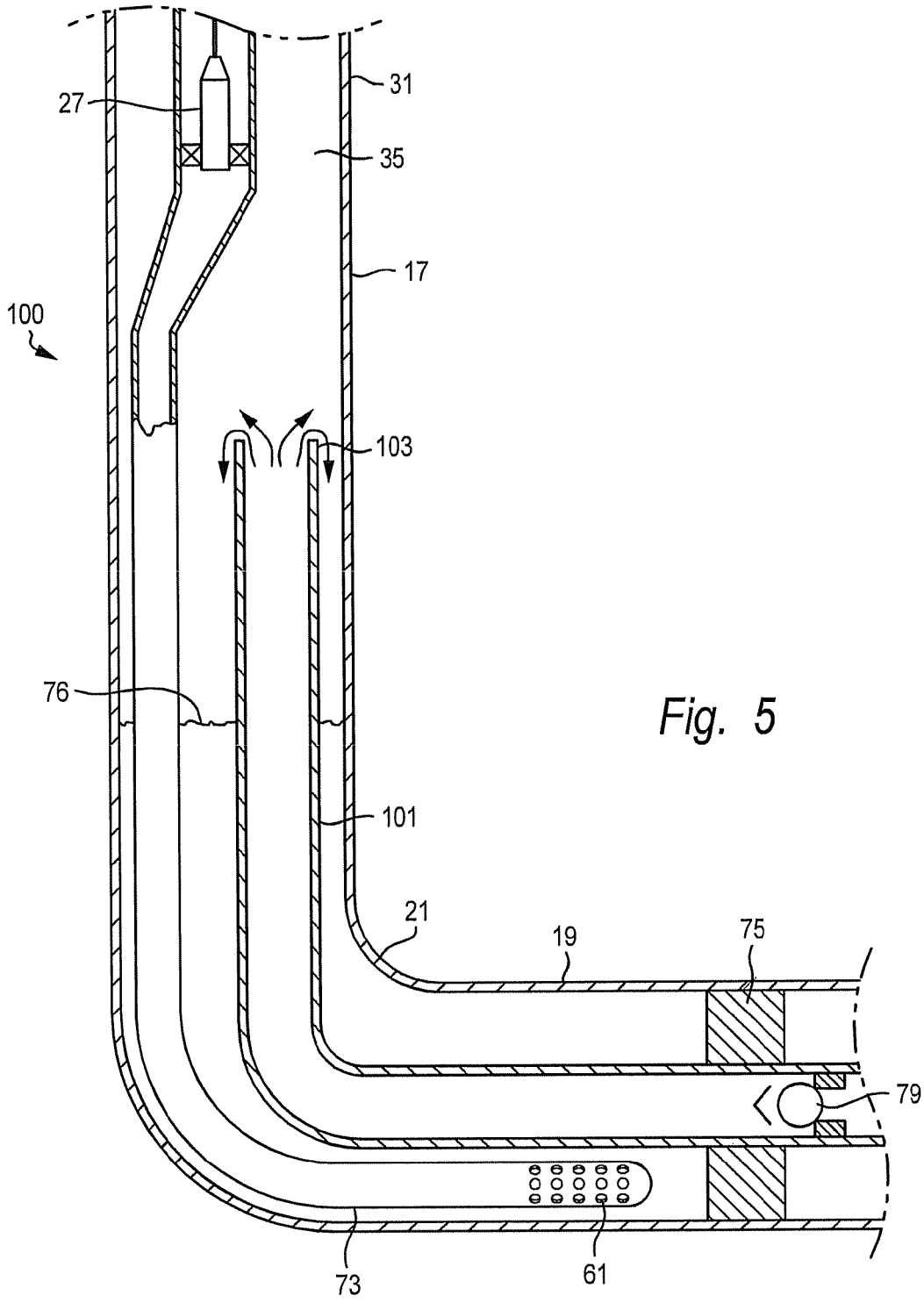
FIG. 5 is a schematic cross-sectional view of a well with the lift system in accordance with another embodiment.

FIG. 5 shows another embodiment of the lift system 100. The pump 27 has an intake that is connected to the remote intake 61 by the dip tube, or intake tube, 73. The well has a packer 75 and a one-way valve 79. A standing tube 101 is connected to the outlet of the one-way valve and extends up the casing for some distance. Thus, any fluid exiting the formation through the one-way valve 79 passes through the standing tube. The outlet 103, or upper end, of the standing tube is located some distance away from the valve 79 and preferably in a portion of the well where the liquid exiting the standing tube falls away from the outlet. As shown in FIG. 5, the outlet 103 is located in the vertical portion 17 of the well.

In the embodiment of FIG. 5, the dip tube 73 and remote intake 61 are located outside of the standing tube 101.

In operation, fluid exits the formation through the standing tube 101. The fluid reaches the outlet 103 and exits the standing tube and falls into the casing 31. The liquid 76 clears the outlet 103 and falls down in the casing. Gas exits the standing tube and moves up the casing 31.

The standing tube 101 is sized in terms of inside diameter, length and vertical height of the outlet relative to the formation flow rate and pressure so that the flow of gas in the standing tube prevents pooling of the liquid inside of the standing tube and cutting off gas flow from the formation. For example, the liquid can be entrained as droplets in the flowing gas or else the liquid can be allowed to collect into slugs, which slugs are small enough so as to be pushed out of the standing tube by the flowing gas.

The liquid 76 that has exited the standing tube collects above the packer 75. To remove the liquid, the pump 27 is operated. As discussed above, compressed gas is provided in the annulus 35 so as to act on the liquid 76 and force the liquid into the remote intake 61 and up the dip tube 73 to the pump 27.

Figure 6A:
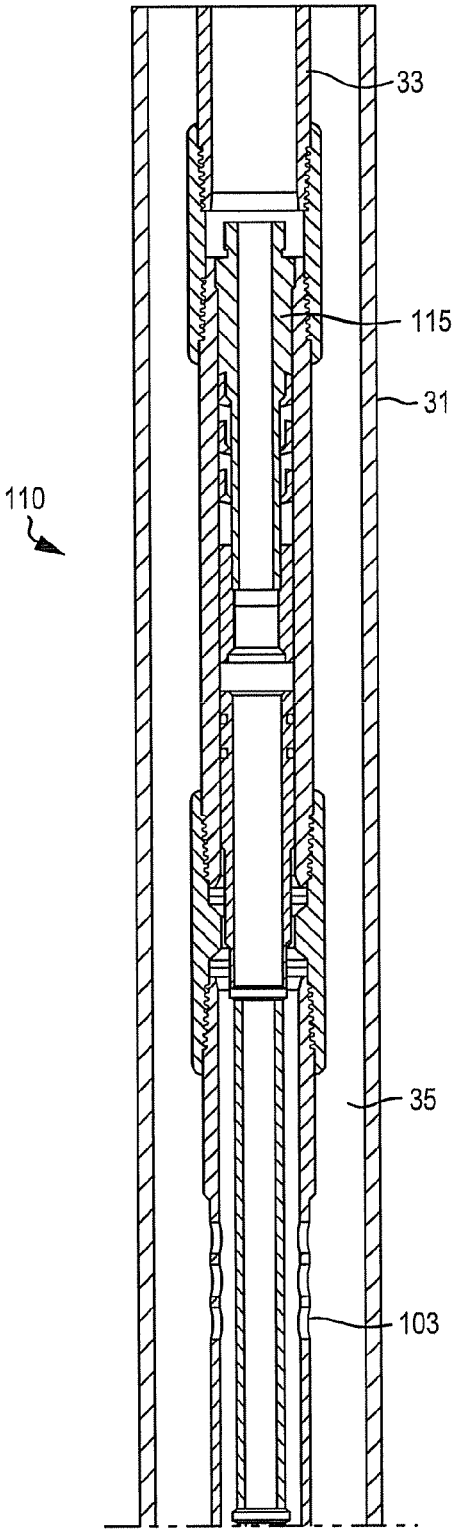
FIGS. 6*a* and 6*b* are a cross-sectional view of a well with the lift system in accordance with still another embodiment.
Figure 6B:
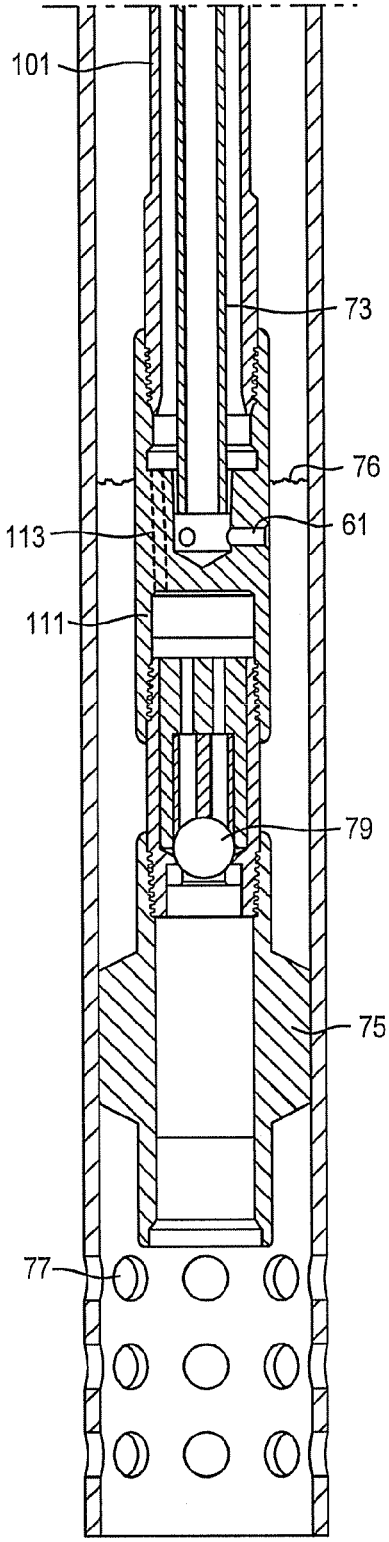

The lift system 110 shown in FIGS. 6*a* and 6*b* (FIG. 6*a* is the upper portion with FIG. 6*b* the lower portion) is similar to the lift system 100 of FIG. 5, however the dip tube or intake tube 73 is located inside of the standing tube 101. The standing tube 101 is coupled to the one-way valve 79 by a bypass coupling 111. The bypass coupling has one or more passages 113 therethrough that allow fluid to flow from the valve 79 through the coupling 111 and into the standing tube 101. The standing tube extends uphole and connects to the tubing 33. The standing tube has an outlet 103 in the form of perforations.

The dip tube 73 is located in the standing tube and extends from the pump (in FIGS. 6*a* and 6*b*, the pump is not shown but the pump connects to the pump hold down 115) down to the bypass coupling 111. The bypass coupling 111 forms the remote intake by way of the port and passage 61 that communicates with the interior of the dip tube and the annulus 35.

In operation, fluid exits the formation through the valve 79 and flows through the passage 113 and rises up the standing tube 101. The fluid exits the standing tube through the outlet 103 perforations and enters the annulus 35. The gas flows up through the annulus 35, while the liquid falls toward the packer 75. Compressed gas is applied to the annulus 35 and the pump is operated. The liquid flows into the remote intake 61 through the dip tube 73 and into the pump as the compressed gas in the annulus 35 forces the fluid into the pump. The pump can be operated before the liquid level in the annulus reaches the standing tube outlet 103 in order to prevent the flooding of the standing tube. The pump is operated in an intermittent fashion as described above with respect to FIGS. 2A and 2B.

The lift systems 100, 110 have the advantage of allowing gas to flow from the formation unimpeded by liquid for as long as the fluid in the annulus is below the standing pipe outlet 103. Well production is thus increased because the flow of gas is relatively high.

The lift systems 100, 110 operate in the same manner as the lift system shown in FIGS. 2A and 2B. The lift systems 100, 110 can be utilized in either horizontal wells or vertical wells.

Although the lift system has been described as utilizing a sucker rod pump, other types of lift systems can be used. Another type of lift system is a progressing cavity pump, which has a type of screw that moves the fluid from one cavity to another and is driven by sucker rods from the surface. The progressing cavity pump has an intake. Another type of lift system is an electrical submersible pump, which has a downhole electric motor that drives a downhole pump. An intake is typically located between the motor and the pump. Still other types of lift systems include a hydraulic diaphragm pump, a hydraulically activated pump, a gear box activated centrifugal pump driven by sucker rods, and an electrically activated pump. The hydraulic diaphragm pump has two hose-like diaphragms that alternate expanding and contracting, or a single hose with a reciprocating piston. A hydraulic activated pump has a hydraulic motor that operates a downhole pump, while the electrically activated pump has an electric motor that operates a downhole pump. These latter four pumps all have pump intakes. Still another type of lift system is a gas lift, which has a liquid intake and gas jets that inject gas into the liquid column. To utilize these lift systems with the invention, the lifting components and their intakes are located in the vertical portions of the well, while a dip tube, with a remote intake, extends from the lifting component intake down into the horizontal portion of the well to a remote intake. The lift system is operated as described above. For example, with a gas well using an electric submersible pump, the dip tube extends up to the pump intake. Referring to FIG. 3, the annulus is provided with compressed gas from times $T_0$-$T_1$ to drive the liquid in the fluid in the well up the dip tube to the pump intake. The pump is operated from times $T_1$-$T_2$ to pump liquid out of the well. Instead of sucker rods, the pump is operated by providing electrical power to the motor. The pump is stopped (or slowed down if it is an electrical submersible pump) at time $T_2$ and gas is produced from the well from times $T_2$-$T_4$.

Lift systems with components that can be installed in the horizontal portion of a well can benefit from the present arrangement. For example, pumps installed in the horizontal portion of a well can experience problems with loading due to gas breaking out of the fluid. If a sufficient amount of gas breaks out of the fluid in the compression chamber, some types of pumps may be unable to pump due to gas interference or gas locking. The additional gas pressure in the annulus will assist in maintaining the fluid at the pump intake under pressure to prevent the gas from breaking out or separating from the liquids thereby allowing the pump to effectively pump by lifting fluid to the surface. As another example, some types of pumps must maintain concentricities and other types of tolerances to operate over extended periods of time. One type of pump is the sucker rod pump, where the plunger is concentric relative to the barrel. Operating the pump in a horizontal or near-horizontal circulation could cause uneven wear between the plunger and the barrel due to the effects of gravity.

Still another type of lift system is a plunger lift. In a plunger lift, the well is shut in and a plunger is dropped from the surface down to the bottom of the well. A column of liquid has developed in the well, necessitating the need for lifting the fluid out. The plunger drops through the column to a bottom point. The well is then opened and pressure from either the formation or an external source is used to push the plunger and its load of liquid up to the surface.

A plunger lift does not work well in a horizontal well because the plunger relies on gravity to drop. Consequently, the plunger has difficultly dropping along the length of the horizontal portion of the well.

However, by using the remote intake, compressed gas moves the liquid up into the vertical portion of the well tubing. The plunger is dropped and rests at a location in the vertical portion, but below the liquid level. The fluid operating level of the plunger lift is above the bottommost location of the plunger. The well tubing is opened at the surface, thereby allowing the plunger and its liquid load to rise to the surface.

Not all lift systems or lift devices have intakes. The plunger lift is such an example. In a broad sense, the lift systems have a fluid operating level. In lift systems such as sucker rod pumps, the fluid operating level is the pump intake. With a plunger lift, the fluid operating level is a level above the bottom point where the plunger rests until rising in the tubing. The compressed gas in the annulus moves the liquid in the well to the fluid operating level of the lift system or the lift device.

Thus, lifting systems of various types can be used to advantage in horizontal wells, without the need to locate the lifting components in the horizontal portion of the well. Instead, the fluid is driven or provided to the vertical portion of the well for lifting to the surface.

The foregoing disclosure and showings made in the drawings are merely illustrative of the principles of this invention and are not to be interpreted in a limiting sense.

The invention claimed is:

1. An artificial lift system for use in a well, the well extending from the surface of the earth into a producing formation, the well having an annulus, the system comprising:

a) a downhole fluid lifting mechanism located in the well, the fluid lifting mechanism having a fluid operating level wherein fluid located at the fluid operating level is operated on by the fluid lifting mechanism to be lifted to the surface, the downhole fluid lifting mechanism comprising a sucker rod pump, having a plunger located in a barrel with one of the plunger or the barrel reciprocating relative to the other of the plunger in the barrel, with a dip tube extending from the pump to a remote intake located below the fluid operating level;

b) the annulus being in fluid communication with the remote intake independent of the fluid lifting mechanism;

c) a compressed gas source independent of the producing formation and connected to the well annulus so as to provide compressed gas at a pressure sufficient to move fluids in the well from the remote intake to the fluid operating level;

d) at least one isolation element that prevents the compressed gas in the annulus from entering the producing formation.

2. The artificial lift system of claim 1, wherein the isolation element comprises a packing seal in the annulus.

3. The artificial lift system of claim 1, wherein the isolation element comprises a one-way valve and tubing, the tubing containing the downhole lifting mechanism and the remote intake.

4. The method of claim 1, wherein the at least one isolation element comprises a packing seal in the annulus and a one-way valve and tubing, the tubing containing the downhole lifting mechanism and the remote intake.

5. The artificial lift system of claim 1, wherein the compressed gas source comprises a compressor.

6. The artificial lift system of claim 1, wherein the compressed gas source comprises a gas sales line.

7. The artificial lift system of claim 1, wherein the compressed gas source comprises an accumulator.

8. The artificial lift system of claim 1, further comprising a controller that controls the inflow and outflow of the compressed gas into the annulus.

9. The artificial lift system of claim 1 wherein the well is a horizontal well having a vertical portion and a horizontal portion, the downhole fluid lifting mechanism located in the vertical portion of the well, the remote intake located in the horizontal portion of the well, the isolation element located in the horizontal portion of the well.

10. The artificial lift system of claim 9 wherein the at least one isolation element comprises a packing seal in the annulus and a one-way valve in tubing, the tubing containing the downhole lifting mechanism and the remote intake.

11. The artificial lift system of claim 1 wherein the well is a vertical well, the downhole fluid lifting mechanism located in the well above the producing formation, the remote intake located in a portion of the well that is adjacent to the producing formation.

12. The artificial lift system of claim 1 further comprising a standing tube extending from the isolation element toward the surface, the standing tube having an outlet, the remote intake located below the standing tube outlet.

13. The artificial lift system of claim 12 further comprising an intake tube extending from the remote intake to the pump, the intake tube located within the standing tube and communicating with the annulus by way of a passage through the standing tube.

14. The artificial lift system of claim 12 further comprising an intake tube extending from the remote intake to the pump, the intake tube located outside of the standing tube.

15. The artificial lift system of claim 1 wherein the one isolation element is located downhole of the remote intake.

16. The artificial lift system of claim 1 wherein the fluid operating level comprises an intake valve.

17. The artificial lift system of claim 1 wherein fluid enters the downhole fluid lifting mechanism exclusively through the remote intake.

18. The artificial lift and system of claim 1 wherein the remote intake is in uninterrupted fluid communication with the fluid lifting mechanism.

19. A method of lifting liquid from a well extending into a producing earth formation, the well having an annulus, comprising the steps of:

a) providing a lifting mechanism in a first portion of the well, the lifting mechanism being a sucker rod pump having a plunger located in a barrel;

b) providing a remote intake in a second portion of the well, which is below the first portion, which remote intake communicates with the lifting mechanism by way of a dip tube and which remote intake communicates with the annulus independent of the lifting mechanism;

c) providing, from a source independent of the producing formation, compressed gas in the annulus so as to move fluid through the remote intake and to the lifting mechanism;

d) isolating the producing formation from the compressed gas in the annulus;

e) operating the lifting mechanism by reciprocating one of the plunger or the barrel with respect to the other of the plunger or the barrel to lift the fluid in the well.

20. The method of claim 19, wherein:

a) the step of providing compressed gas in the annulus further comprises the step of intermittently providing the compressed gas in the annulus and releasing the compressed gas from the annulus;

b) the step of operating the lifting mechanism to lift the fluid in the well further comprises the step of intermittently operating the lifting mechanism when the compressed gas is in the annulus and ceasing operation of the lifting mechanism when the compressed gas is released from the annulus.

21. The method of claim 19 further comprising the steps of:

a) providing a standing tube extending from the isolated formation toward the earth's surface;

b) locating the remote intake below an outlet of the standing tube.

22. The method of claim 19 wherein the step of isolating the producing formation from the compressed gas in the annulus further comprises the step of isolating the producing formation at a location that is below the remote intake.

23. The method of claim 19 further comprising the step of providing fluid to enter the downhole fluid lifting mechanism exclusively through the remote intake.

24. The method of claim 19 further comprising the step of allowing fluid from the producing formation into the annulus before the step of providing, from a source independent of the producing formation, compressed gas into the annulus so as to move fluid through the remote intake and to the lifting mechanism.

25. The method of claim 19 wherein the remote intake, without interruption, communicates with the lifting mechanism.

26. The method of claim 19 wherein the first portion of the well is a vertical portion and the second portion of the well is a horizontal portion, the step of isolating the producing formation from the annulus further comprising isolating the producing formation at a location in the horizontal portion.

* * * * *